US005341768A

United States Patent [19]

Pope

[11] Patent Number: 5,341,768

[45] Date of Patent: Aug. 30, 1994

[54] APPARATUS FOR FRICTIONALLY HEATING LIQUID

[75] Inventor: Ralph E. Pope, Cumming, Ga.

[73] Assignee: Kinetic Systems, Inc., Lynn, N.C.

[21] Appl. No.: 124,019

[22] Filed: Sep. 21, 1993

[51] Int. Cl.[5] ..... F24C 9/00

[52] U.S. Cl. ..... 122/26; 126/247

[58] Field of Search ..... 122/26; 126/247; 237/1 R; 415/71, 120, 143, 206

[56] References Cited

U.S. PATENT DOCUMENTS 3,333,771 8/1967 Graham .
4,143,639 3/1979 Frenette .
4,256,085 3/1981 Line .
4,277,020 7/1981 Grenier .
4,357,931 11/1982 Wolpert et al. .
4,372,254 2/1983 Hildebrandt .
4,424,797 1/1984 Perkins .
4,483,277 11/1984 Perkins .
4,501,231 2/1985 Perkins .
4,651,681 3/1987 Perkins .
4,779,575 10/1988 Perkins .
4,798,176 1/1989 Perkins .
5,279,262 1/1994 Muehleck ..... 122/26

*Primary Examiner*—Edward G. Favors
*Attorney, Agent, or Firm*—Oblon, Spivak, McClelland, Maier & Neustadt

[57] ABSTRACT

A heater for heating liquid by friction includes a rotor rotatable within a housing filled with liquid, the rotor having passages arranged to expel liquid through friction orifices by centrifugal force from a pair of inlet cavities on opposite sides of the rotor. The outlets of the passages lie in a common plane on the periphery of the rotor whereas the inlets of alternate passages open alternately into the respective inlet cavities. The housing has a plurality of outlets lying in the plane of the rotor outlets with one of the housing outlets leading to a heat utilization device while the other housing outlets are connected to by-pass passages leading back into the housing through the side or sides thereof. The constant in-flow from the by-pass passages virtually eliminates cavitation while the pre-heated liquid in the passages adds to the heat of the liquid in the housing otherwise frictionally heated by rotation of the rotor.

10 Claims, 3 Drawing Sheets

APPARATUS FOR FRICTIONALLY HEATING LIQUID

FIELD OF THE INVENTION

This invention relates to liquid heating apparatus and more particularly to apparatus which heats liquid by friction.

BACKGROUND OF THE INVENTION

It is known to heat liquid by rotating a rotor in a reservoir of liquid, such an arrangement being shown in the patent to Perkins U.S. Pat. No. 4,798,176 assigned to the same assignee as the present application. In that patent scoops at the periphery of a rotor pick-up liquid as the rotor is rotated and direct the liquid through inwardly directed passages in the rotor to a central outlet cavity in the rotor which is in open communication with a central outlet port in the rotor housing. This arrangement was found to deal satisfactorily with cavitation problems but the liquid driven inwardly was opposed by centrifugal force tending to drive the liquid outwardly. In other words, though the arrangement addressed cavitation problem, it clearly was not as efficient as it could have been.

Another arrangement for preventing cavitation while taking advantage of centrifugal force is shown in a patent to Perkins U.S. Pat. No. 4,779,575. That patent involves the use of pump means which delivers liquid to a central cavity in a rotor from which liquid is expelled by centrifugal force through passages in the rotor to its periphery whence the liquid flows through an outlet in the rotor housing to a heat utilization device. Because the pump operated on the scoop principal similar to the rotor in U.S. Pat. No. 4,798,176 the pumped liquid was again subject to opposing forces tending to reduce the overall efficiency of the heater.

The broad object of the present invention is to provide a heater for heating liquid by friction but with enhanced efficiency over prior systems.

SUMMARY OF THE INVENTION

The invention provides a single heating rotor having a pair of central inlet cavities on opposite sides of a central web. A plurality of passages, say 24, having restrictive orifices therein, are arranged in the rotor angularly related to its axis of rotation in a manner inducing them to impel liquid with great centrifugal force through the restricted orifices thereby frictionally heating the liquid. The passages have outlets circumferentially spaced on the periphery of the rotor and lying in a plane bisecting the rotor. The rotor is rotated by an outside power source in a housing filled with liquid and having a plurality of outlets also lying in the plane bisecting the rotor. Alternate rotor passages, say every other one of 24 or 12, have inlets connecting alternate outlets with one inlet cavity. The other alternate passages, also 12 in number, have inlets connecting the other alternate outlets to the second inlet cavity. One of the outlets from the housing leads to a heat utilization device, say, a heat exchanger. There are also a plurality of inlets in one or both sides of the housing, one of the inlets being connected to an outlet of the heat utilization device and the other inlets being connected by by-pass passages to the other outlets in the housing. The pumping capacity of the rotor exceeds the capacity of the outlet leading to the heat utilization device. The excess liquid which is thus pumped flows freely through the other outlets and by-pass passages which relieves pressure in the housing, thus reducing driving power requirements while also reducing the chance of cavitation, which is further reduced, nearly to zero, due to the constant in-flow of liquid from both the heat utilization device and the by-pass passages. Further, the preheated liquid in the by-pass passages flowing into the housing continuously adds to the heat generated in the liquid by action of the rotor. It has been found that the overall efficiency of the arrangement of the present invention is markedly improved over the efficiency of previously known systems.

DETAILED DESCRIPTION OF THE INVENTION

Figure 2:
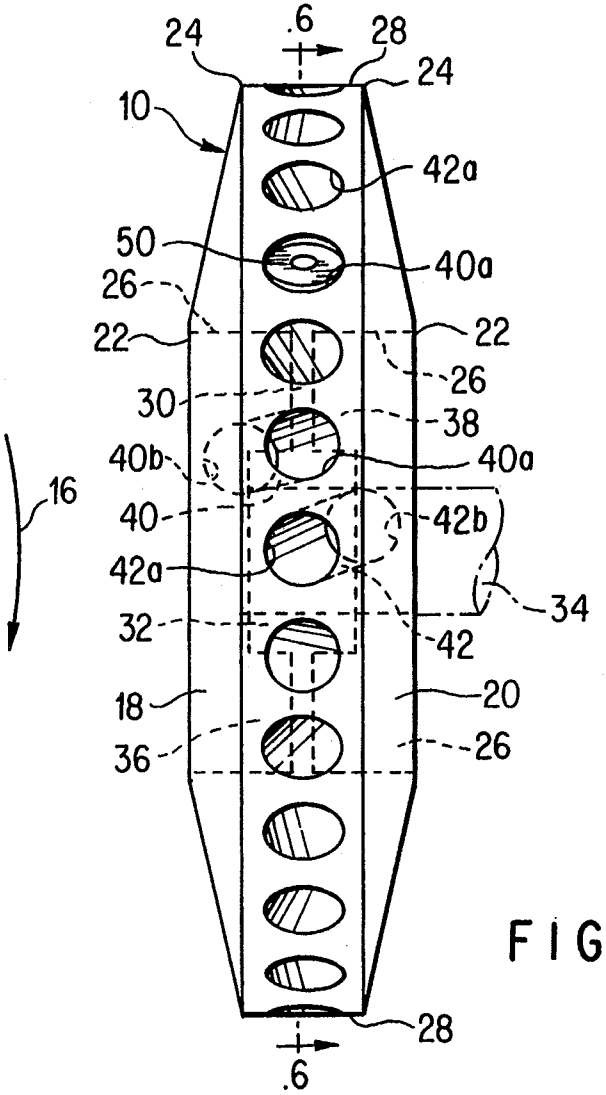
FIG. 2 is a side elevation of the rotor of FIG. 1.
Figure 1:
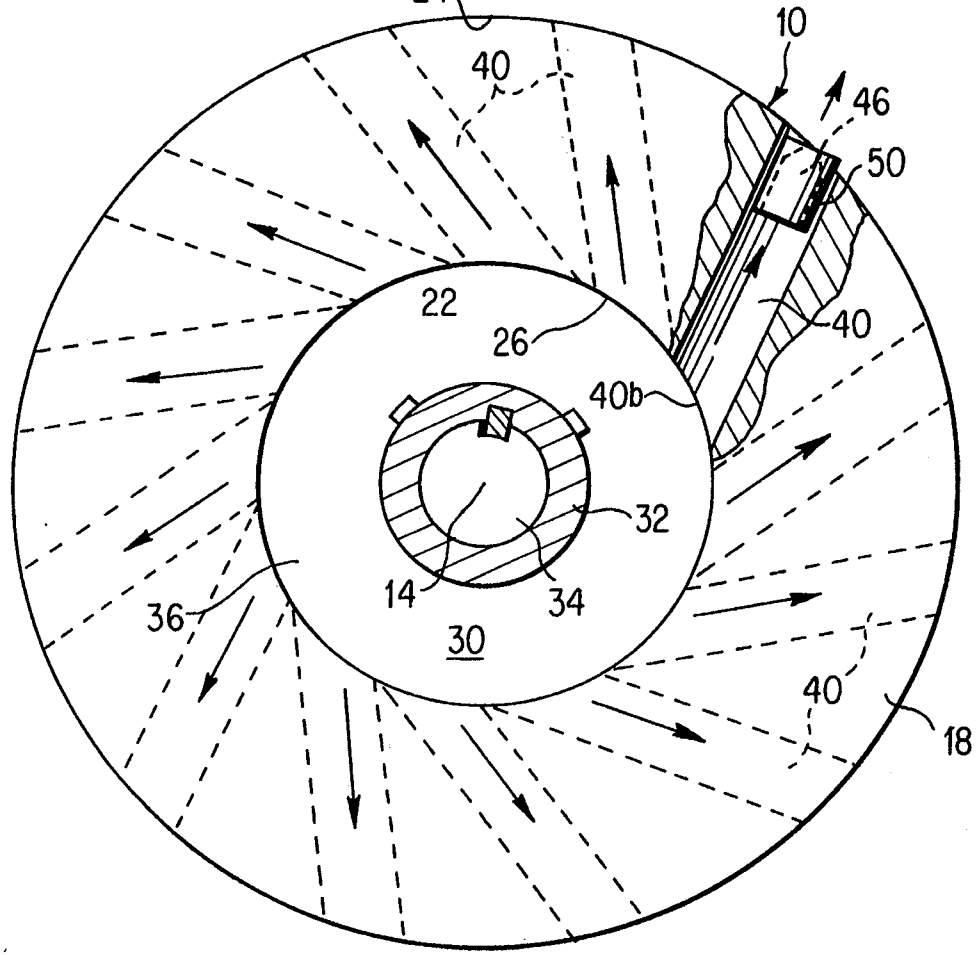
FIG. 1 is a vertical elevation, partly broken away of one side of a rotor constructed in accordance with the invention, the opposite side of the rotor being essentially a mirror image of the rotor as shown in FIG. 1.

With reference to FIGS. 1 and 2 the liquid heating apparatus of the invention comprises an impeller or rotor 10, broadly designated by the numeral 10, designed to be disposed within a housing 12, (FIGS. 3 and 4) defining a reservoir for a heat transfer liquid. The rotor 10 is rotatable about an axis of rotation 14 in a predetermined direction as indicated by the arrow 16. The rotor 10 comprises axially spaced front and rear annular face members 18, 20 each having radially spaced inner and outer edges 22, 24. Radially spaced inner and outer cylindrical surfaces 26, 28 of predetermined axial width join the respective inner and outer edges 22, 24 of the face members 18, 20.

A web 30 having an axial width substantially less than the axial width of the inner cylindrical surface 26 (see FIG. 2) is fixed to the surface 26 midway of the width thereof, the web 30 being provided with a central collar 32 for receiving a rotor driving shaft 34. The web 30 with the inner cylindrical surface 26 on either side of the web define first and second annular inlet cavities 36, 38 in the rotor.

Figure 6:
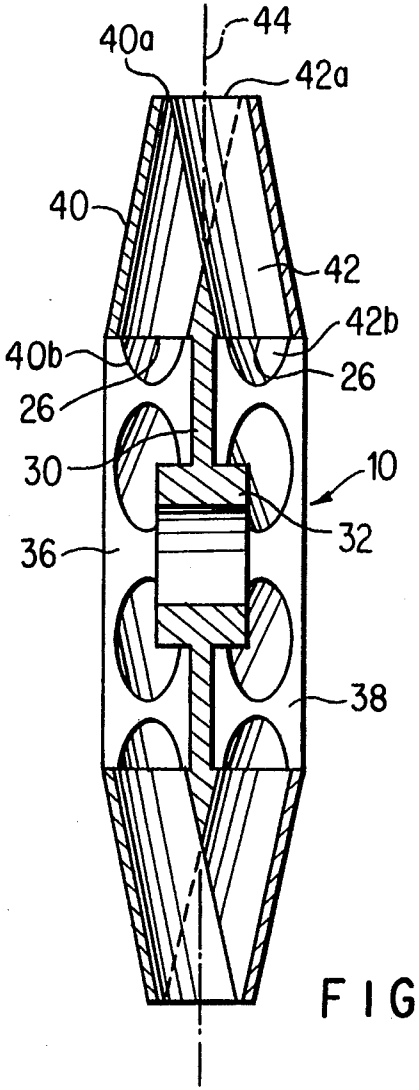
FIG. 6 is a vertical cross sectional view, partly schematic, illustrating the arrangement of liquid passages within the rotor.

A plurality of fluid transfer passages 40, 42 are provided in the rotor 10, which for purposes of illustration, may total 24 one-half of the total number, say passages 40 numbering 12, lead to the first inlet cavity 36 and the remaining passages 42 lead to the second inlet cavity 38. As can be seen in FIGS. 2 and 6, the passages 40, 42 have outlets 40*a*, 42*a* lie symmetrically in common plane 44 bisecting the rotor end all of which are equally circumferentially spaced around and opening through the outer cylindrical surface 28 as should be clear in FIGS. 2. Alternate ones of the passages, say the passages 40, have inlets 40*b* opening through the inner cylindrical surface 26 on one side of the web 30 to connect the alternate ones of the outlets 40*a* with the first inlet cavity 36. The other alternate ones of the passage 42 have inlets 42*b* opening through the inner cylindrical surface 26 on the other side of the web 30 to connect said other alternate outlets 42*a* with the second inlet cavity 38.

The invention is dependent, in part, on the ability of the rotor to pump past its periphery an amount of liquid in excess of a receiver's capacity to accept the quantity pumped, as will become apparent hereinafter. To provide this excess pumping capacity a large number of liquid transfer passages 40, 42 are required in the rotor and though there is space on the peripheral cylindrical surface 28 for the passage outlets 40*a*, 42*a* there is not sufficient space on the inner peripheral surface 26 for all the inlets 40*b*, 42*b*. Thus, in accordance with the invention, the respective alternate passages 40, 42 are alternately axially sloped as shown in FIG. 6 so that their respective inlets 40*b*, 42*b* are located in the respective inlet cavities 36, 38 whereas their outlets 40*a*, 40*b* lie symmetrically in the plane 44 bisecting the rotor, see FIG. 4.

As can be seen in FIG. 1 the passages 40, and also the passages 42, hidden in FIG. 1 to reduce confusion, all slope generally with respect to the axis of rotation 14 of the rotor in a direction opposite to the predetermined direction 16 of rotor rotation. Thus liquid in the passages 40 (and 42) are impelled through the passages with high centrifugal force. In order to cause liquid flowing through said passages to become frictionally heated each passage 40, 42 is provided along its length, preferably at its outlets, with a restricted orifice 46 which may be formed in a threaded insert 50, only one such insert being shown in FIG. 1 though all passages have identical inserts.

Figure 4:
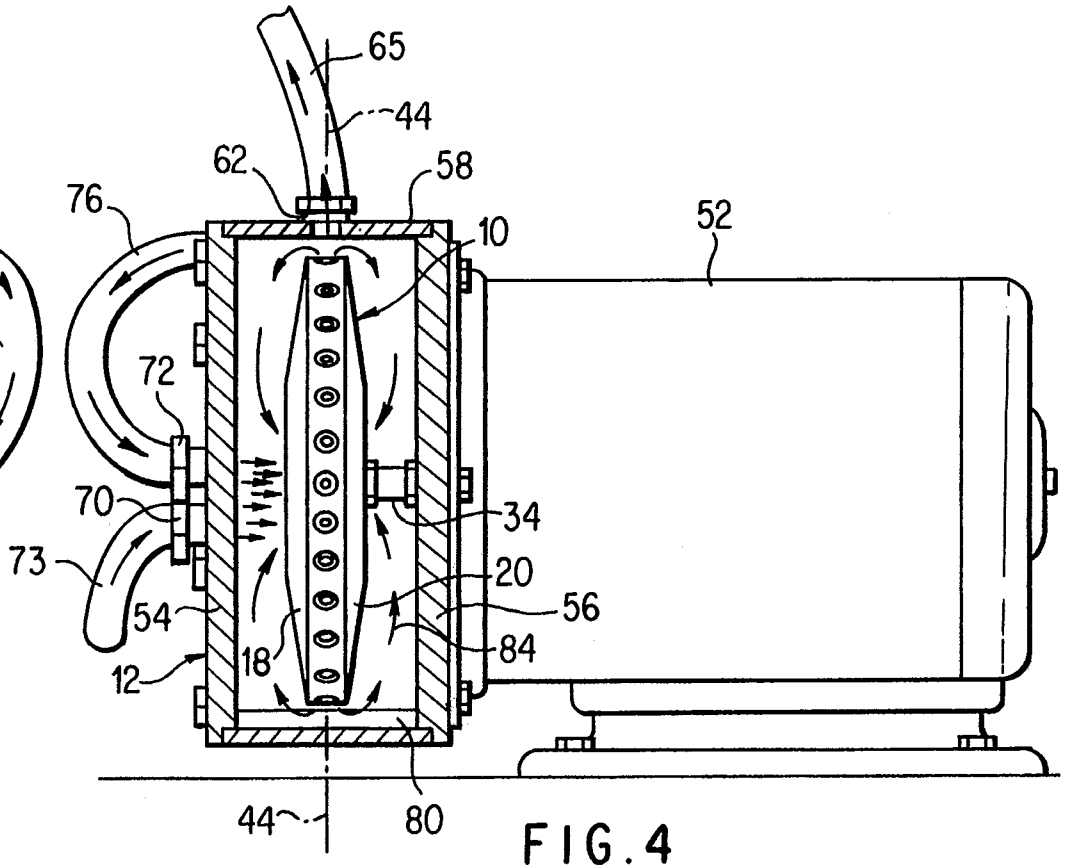
FIG. 4 is a side view partly in section and partly in elevation of the assembly of FIG. 3 and including a driving motor.
Figure 3:
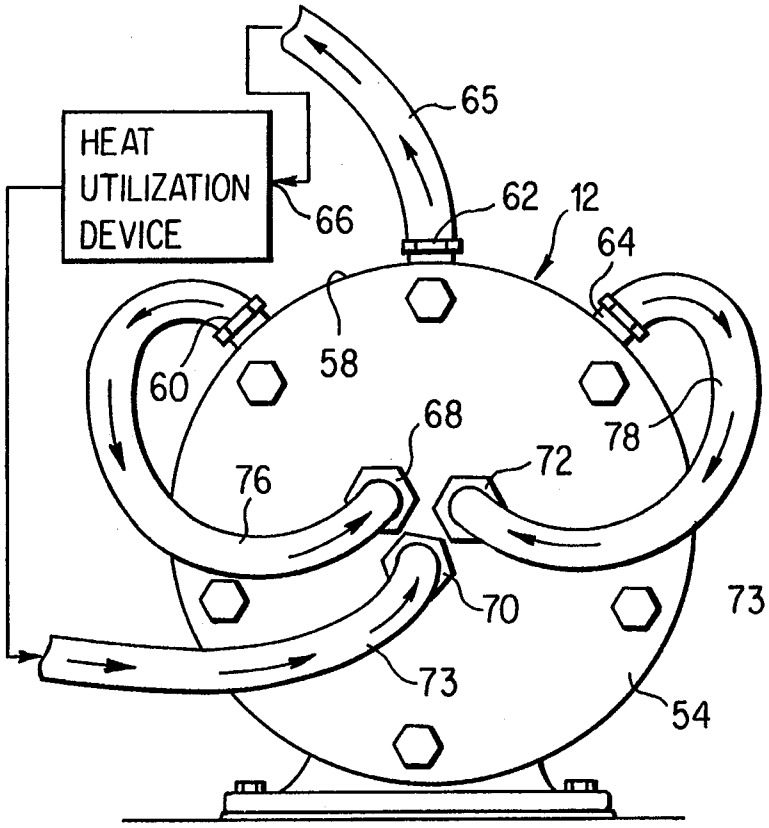
FIG. 3 is an end elevational view on a reduced scale of a rotor housing incorporating the invention.

Referring now to FIGS. 3 and 4, the rotor 10 is disposed within the housing 12 with means, such as the motor 52 being provided to rotate the rotor 10 through shaft 34 in the predetermined direction 16. The housing has a pair of axially spaced end walls 54, 56 joined by a cylindrical side wall 58 whose internal diameter is substantially complementary to the diameter of the rotor 10. As best seen in FIG. 3 there are a plurality of outlets 60, 62, 64 through the side wall 58. At least one outlet, in this case outlet 62, leads by way of pipe 65 to an inlet of a heat utilization device 66, which may be a heat exchanger.

In accordance with the invention, inlets 68, 70, 72 are provided through at least one end wall, in this case end wall 54 though, should the drive motor 52 be spaced to the right of rotor housing 12, one or more inlets could also be located in end wall 56. The number of inlets 68, 70, 72 are equal in number to the outlets 60, 62, 64 and at least one of the inlets, say inlet 70, is connected by a pipe 73 to the outlet of the heat utilization device 66, with by-pass passages 76, 78 connecting the other outlets 60, 64 with corresponding inlets 68, 72. There could be additional by-passages.

As is evident in FIG. 4, all of the outlets 60, 62, 64 through the side wall 58 of the rotor housing 12 lie in the same plane 44 bisecting the rotor whereby as the rotor rotates the outlets 40*a*, 42*a* of the passages 40, 42 in the rotor successively align with the housing outlets 60, 62, 64 to project liquid from the rotor outlets directly into the housing outlets.

Figure 5:
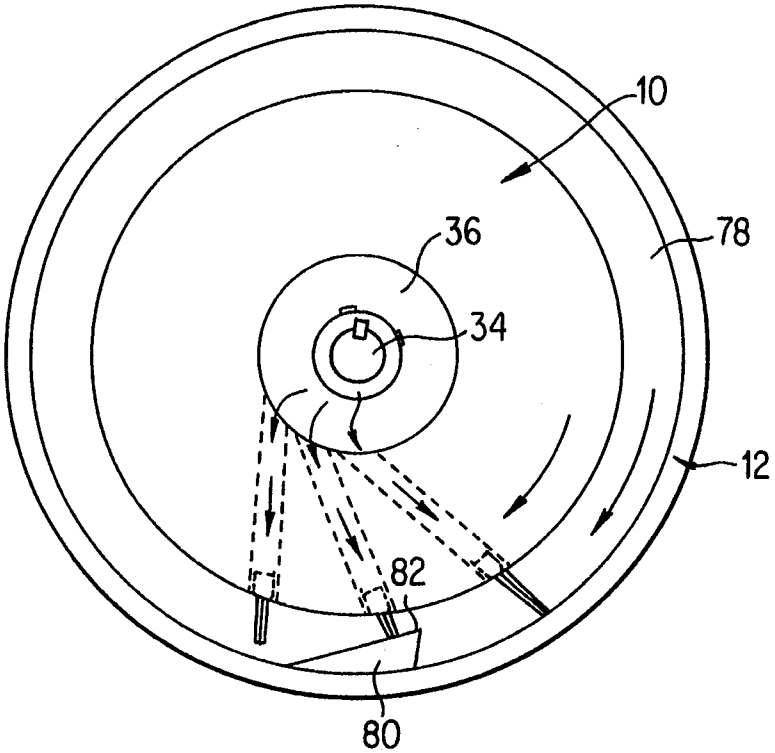
FIG. 5 is an end view of the rotor and housing with parts omitted, including a side of the rotor housing, illustrating a friction-increasing liquid shearing ramp which may be used with the rotor of the invention.

As can be seen in FIG. 5 the outer diameter of the rotor 10 is less than the inner diameter of the housing 12 to provide an annular space 78 between the housing and rotor. At least one wedge shaped ramp 80 is fixed to the housing in the space 78 and has an edge 82 terminating in close adjacency to the periphery of the rotor whereby the ramp further frictionally heats the liquid through shearing action as liquid is impelled through the passages 40, 42 in the rotor. Desirably, the ramp's wedge shape diverges in a direction opposite to the predetermined direction of rotation of the rotor but it is within the purview of the invention for the wedge shape to diverge in the direction of rotor rotation. Furthermore, there can be more than one ramp.

It is believed that the operation of the invention should be clear from the foregoing description. To summarize, in order to ensure high pumping capacity by the rotor a large number of liquid passages 40, 42 are provided in the rotor, and though the outlets of these passages can be accommodated on the outer periphery of the rotor, the inlets are too numerous to be accommodated in a single inlet cavity. Thus two inlet cavities 36, 38 are provided with the inlets of alternate passages 40, 42 opening into the respective inlet cavities 36, 38. The total flow projected through the passage outlets 40*a*, 42*a* onto the rotor outlet 62 leading to the heat utilization device exceeds the capacity of that outlet, with some of excess pumped liquid flowing through the by-pass passages 76, 78 back into the rotor housing 12 where this continuous in-flow liquid substantially decreases or eliminates cavitation while the pre-heated by-pass liquid contributes to the heat in the liquid otherwise heated by its contact with the exterior of the entire rotor, by being impelled through the restricted orifices 46 in the rotor passages and by the effects of one or more wedge shaped liquid shear ramps 80. It will be understood that liquid issuing through those motor outlets when not in alignment with the housing outlets impinge on the wall of the housing and is reflected back into the inlet cavities, as indicated by the arrows 84 in FIG. 4 all of which contributes to the frictional heating of the liquid. The by-pass passages 76, 78 not only obviate cavitation but they serve to quickly re-heat the nearly cold liquid returning to the rotor housing from the heat exchanger 66.

Having now described the invention, it will be apparent that it is susceptible of changes and modifications without, however, departing from the scope and spirit of the appended claims.

What is claimed is:

1. Apparatus for heating liquid comprising: a rotor for disposition within a housing defining a reservoir for a heat transfer liquid, said rotor being rotatable about an axis of rotation in a predetermined direction and having axially spaced front and rear annular face members each having radially spaced inner and outer edges, radially spaced inner and outer cylindrical surfaces of predetermined axial width joining the respective inner and outer edges of said face members, a web having an axial width substantially less than the axial width of said inner cylindrical surface and being fixed to said surface midway of the width thereof, said web with said inner cylindrical surface on either side of said web defining first and second annular inlet cavities in said rotor, and a plurality of passages in said rotor having outlets circumferentially spaced around and opening through said outer cylindrical surface, alternate ones of said passages having inlets opening through said inner cylindrical surface on one side of said web to connect said alternate ones of said outlets with said first inlet cavity, the other alternate ones of said passages having inlets opening through said inner cylindrical surface on the other side of said web to connect said other alternate outlets with said second inlet cavity.

2. The apparatus of claim 1 wherein said passages all slope generally with respect to said axis of rotation of said rotor in a direction opposite to the predetermined direction of rotation of said rotor to impel liquid through said passages with high centrifugal force.

3. The apparatus of claim 2 wherein said outlets through said outer cylindrical surface lie symmetrically within a plane bisecting said rotor.

4. The apparatus of claim 2 wherein said passages are substantially straight between said inlets and outlets, the alternate passages sloping in an axial direction towards said first inlet cavity, the other alternate passages sloping in an opposite axial direction towards said second inlet cavity.

5. The apparatus of claim 1 wherein said passages are arranged relative to the axis of rotation of said rotor in said predetermined direction to impel liquid to flow by centrifugal force from said first and second inlet cavities through said passages outwardly of said rotor, and restricted orifices in said fluid passages to cause liquid to become frictionally heated as it is impelled through said orifices.

6. The apparatus of claim 5 including said housing, and means for rotating said rotor within said housing in said predetermined direction, said housing having a pair of axially spaced end walls joined by a cylindrical side wall whose internal diameter is substantially complementary to the diameter of said rotor, a plurality of outlets through said side wall, at least one outlet leading to an inlet of a heat utilization device, a plurality of inlets through at least one end wall of said housing, there being at least the same number of inlets as outlets, at least one inlet being connected to an outlet of said heat utilization device, and by-pass passages connecting at least some of the other of said outlets with corresponding other of said inlets.

7. The apparatus of claim 6 wherein all of said outlets through the side wall of said housing lie in the same plane bisecting said rotor whereby the outlets in said rotor successively align with the outlets through the side walls of said housing as said rotor is rotated to project liquid from the outlets of said rotor directly into the outlets of said housing.

8. The apparatus of claim 7 wherein the outer diameter of said rotor is less than the inner diameter of said housing to provide an annular space between said housing and rotor, and at least one wedge shaped ramp fixed to said housing ramp in said space, said ramp having an edge terminating in close adjacency with the periphery of said rotor, said ramp further frictionally heating said liquid through shearing action as said liquid is impelled through the passages in said rotor by rotation thereof.

9. The apparatus of claim 8 wherein said wedge shaped ramp diverges in a direction opposite to the rotation of said rotor in its predetermined direction.

10. The apparatus of claim 7 wherein the liquid pumped through the outlets in said rotor exceeds the capacity of said outlet to leading to said heat utilization device to accept said pumped liquid, at least some of said excess liquid being accepted by said by-pass passages.

* * * * *